US006028561A

United States Patent [19]

Takei

[11] Patent Number: 6,028,561

[45] Date of Patent: Feb. 22, 2000

[54] TUNABLE SLOT ANTENNA

[75] Inventor: Ken Takei, Hachioji, Japan

[73] Assignee: Hitachi, Ltd, Tokyo, Japan

[21] Appl. No.: 09/035,848

[22] Filed: Mar. 6, 1998

[30] Foreign Application Priority Data

Mar. 10, 1997 [JP] Japan ..... 9-054825

[51] Int. Cl.[7] ..... H01Q 13/10

[52] U.S. Cl. ..... 343/767; 343/700 MS; 343/746; 343/750; 343/768

[58] Field of Search ..... 343/767, 768, 343/700 MS, 701, 746, 750; H01Q 13/10

[56] References Cited

U.S. PATENT DOCUMENTS

| | | | |
|---|---|---|---|
| 4,197,545 | 4/1980 | Favaloro et al. | 343/767 |
| 5,136,304 | 8/1992 | Peters | 343/777 |
| 5,489,913 | 2/1996 | Raguenet et al. | 343/767 |

FOREIGN PATENT DOCUMENTS

| | | | |
|---|---|---|---|
| 63-294107 | 11/1988 | Japan | H01Q 13/08 |
| 9-074312 | 3/1997 | Japan | H01Q 13/18 |

OTHER PUBLICATIONS

"Antenna Engineering Handbook", The Institute of Electronics and Communication Engineers of Japan, published by Ohm Co., Ltd., Oct. 1980, pp. 43–46.

*Primary Examiner*—David H. Vu
*Assistant Examiner*—Hoang Nguyen
*Attorney, Agent, or Firm*—Antonelli Terry, Stout & Kraus, LLP

[57] ABSTRACT

In order to offer a tunable slot antenna capable of varying an impedance matching center frequency thereof, there is provided a coaxial resonant slot antenna for supplying RF power to a strip conductor placed in a flat conductive cubic with a slot formed in its upper surface and electrically insulated from the flat conductive cubic, wherein a variable capacitor is electrically connected between one point lying in the neighborhood thereof including an end far from a RF power connection point on the strip conductor and a side wall of the flat conductive cubic, and a d.c. voltage to be applied across the variable capacitor is supplied to the connection point.

26 Claims, 10 Drawing Sheets

TUNABLE SLOT ANTENNA

BACKGROUND OF THE INVENTION

1. Field of the Invention

This invention relates to an antenna suitable for use in a radio terminal, and particularly to a slot antenna utilizing a coaxial cavity.

2. Description of the Related Art

A radio terminal has made progress in its size and thickness reductions in terms of an improvement in portability. At the same time, various types of small-sized antennas to be mounted to such a radio terminal have been developed. Of these, a slot antenna using a coaxial cavity has a feature that it can be built in the terminal without having to use a projection. In particular, a coaxial resonant slot antenna reduced in size by means of a structure wherein a center conductor (strip conductor) thereof is kept in non-contact with a cavity cubic (flat conductive cubic), has been proposed by Japanese Patent Laid-Open (Kokai) No. Hei 9-74312. An example of the structure thereof will be illustrated in FIG. 10.

The present antenna comprises a flat conductive cubic 1 shaped in a rectangular parallelepiped as a whole, a slender strip conductor 3, which extends along the direction of a resonant axis of a space inside the flat conductive cubic 1 and which is placed so as to be electrically insulated from the flat conductive cubic 1, and a radio wave transmitting and receiving slot 2 formed on the upper surface of the flat conductive cubic 1 so as to intersect the strip conductor 3. A RF source 7 feeds the RF power between a connection point 10 set to the strip conductor 3 and a side wall of the flat conductive cubic 1. The antenna can be much reduced to a few mm or less in thickness. Further, the antenna can be fabricated using the ordinary multilayer circuit board manufacturing process and has a great effect on size and cost reductions in terminal.

Since the antenna includes a cavity structure, the volume of the antenna is directly proportional to an impedance matching band. Thus, a problem arises in that when the antenna is applied to a terminal of a wide band radio communication system brought into large capacity using a plurality of carrier frequencies, an impedance matching frequency band to be ready for the antenna spreads and the volume of the antenna increases.

Since a phone call is normally made between a base station and a terminal, using one frequency shared between transmitting and receiving or two frequencies according to transmitting and receiving, a frequency band used at that time is very narrower than that of the entire system. Thus, if the impedance matching center frequency of the antenna can be adaptively varied to a frequency used on the phone for each phone call, then the frequency band to be possessed by the antenna can be reduced and hence the volume of the antenna can be lessened. Furthermore, a technique for adaptively varying the impedance matching center frequency of the antenna has been disclosed in Japanese Patent Laid-Open (Kokai) No. Shou 63-294107. However, the same publication contains no mention of the structure of the coaxial resonant slot antenna.

SUMMARY OF THE INVENTION

An object of the present invention is to provide a novel coaxial resonant slot antenna capable of varying an impedance matching center frequency thereof.

The problems to be handled by the present invention can be effectively solved by electrically connecting a variable capacitor between one point (hereinafter called "capacitor connecting point") lying in the neighborhood thereof including an end far from a connection point of a strip conductor, which is supplied with RF power, and a side wall of a flat conductive cubic. This is because if such means is adopted, then the impedance matching center frequency of the antenna, i.e., the resonance frequency can be changed by varying the capacitance value of the variable capacitor.

As described in the former above-described Patent Laid-open, the resonance frequency of the coaxial resonant slot antenna is substantially determined according to the length (about resonant wave length/4) of the strip conductor. On the other hand, a technique for mounting a lump load to the leading end of a strip conductor to thereby electrically vary the length of the strip conductor on an equivalent basis has heretofore been well known (e.g. see "Antenna Engineering Handbook" edited by The Institute of Electronics and Communication Engineers of Japan, published by Ohm Co., Ltd., pp 43, October 1980). The length of the strip conductor varies apparently because the density of electric lines of force extending from the leading end of the strip conductor having a potential as a feeding line to a ground potential varies according to the lump load electrically connected to the leading end of the strip conductor. In the present invention, a variable capacitor is used as the lump load. The variable capacitor may preferably be a device whose capacitance value varies according to the application of a d.c. voltage thereacross. For example, a variable capacitance diode can be used as such a device.

Incidentally, the variable capacitor is not directly connected to the capacitor connecting point. In this case, the electrical connection between the variable capacitor and the capacitor connecting point can be achieved by placing the variable capacitor outside the flat conductive cubic, and connecting the variable capacitor and the capacitor connecting point with a line conductor extending through the flat conductive cubic.

Described specifically, a small hole is made in the upper surface of the flat conductive cubic above the capacitor connecting point. One end of the short line conductor is electrically connected to the capacitor connecting point and the other end thereof is drawn through the small hole. Thereafter, the variable capacitor is electrically connected between the other end thereof drawn through the small hole and a side wall lying in the vicinity of the small hole.

The other end drawn through the small hole is identical in potential to the capacitor connecting point. Any place on the side wall of the flat conductive cubic is maintained at a ground potential. Thus, the electrical connection of the variable capacitor to the other end can bring about the same effect as when the variable capacitor is directly connected to the capacitor connecting point.

The use of such an antenna in a terminal of a radio communication system allows the tuning of the resonance frequency of the antenna to a radio frequency set for each phone call. Since a band necessary for the call may exist, the frequency band for the antenna is very narrower than the entire frequency band occupied by the radio communication system. Thus, the antenna can be reduced in volume as compared with an antenna for covering the entire frequency band. As a result, the antenna can be easily built in the terminal. In the above description, the linear conductor for connecting the variable capacitor to the capacitor connecting point has been drawn to the upper surface of the flat conductive cubic. However, the linear conductor is not necessarily limited to this method. It is needless to say that the linear conductor may be drawn to the bottom face or side of the flat conductive cubic. This can obtain the same effect as described above.

Since the connection point of the strip conductor and the capacitor connecting point are identical in potential under the action of the direct current, a portion for feeding the d.c. voltage to be applied across the variable capacitor can be matched with the connection point. A RF power that superimposes the d.c. voltage thereon, is supplied to the connection point in this case. The superimposition of the d.c. voltage thereon can be achieved by electrically connecting an output terminal of a voltage variable d.c. source (hereinafter called "variable d.c. source") to the connection point through a device for blocking the flow of a high-frequency current when an output terminal of a RF source is in an open state under action of a direct current, for example.

Next, since the antenna according to the present invention can be brought into less size, it can be mounted to a high-frequency circuit board and formed integrally with related wires, devices and circuits. These can be placed so as to be very close to one another. Thus, a coaxial resonant slot antenna suitable for use in a GHz band can be realized.

Further, the antenna according to the present invention can be constructed using a multilayer circuit board. It is thus possible to obtain an easy-to-manufacture antenna of high practical use. Event in this case, the antenna can be formed integrally with related wires, devices and circuits. Thus, a coaxial resonant slot antenna suitable for use in a GHz band can be materialized in the same manner as described above.

These and other objects and many of the attendant advantages of the invention will be readily appreciated as the same becomes better understood by reference to the following detailed description when considered in connection with the accompanying drawings.

BRIEF DESCRIPTION OF THE DRAWINGS

The present invention will now be described with reference to the accompanying drawings wherein.

DETAILED DESCRIPTION OF THE PREFERRED EMBODIMENTS

Figure 1A:
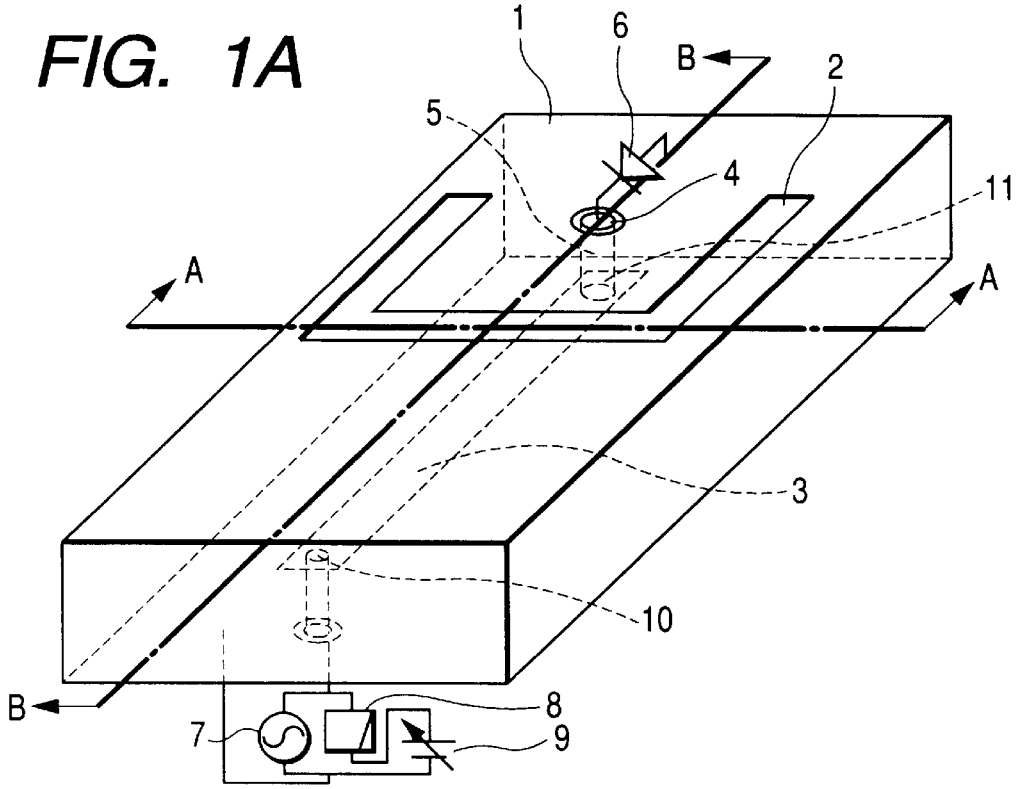
FIG. 1A is a perspective view for describing a first embodiment of a tunable slot antenna according to the present invention.

A coaxial resonant slot antenna according to the present invention will hereinafter be described in further details by several preferred embodiments shown in the accompanying drawings. Incidentally, the same reference numerals shown in FIGS. 1 through 10 indicate the same elements of structure or similar elements thereof respectively.

[First Embodiment]

Figure 1B:
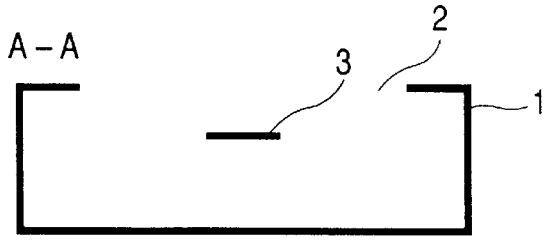
FIG. 1B is a cross-sectional view taken along line A—A of FIG. 1A, for describing the first embodiment of the tunable slot antenna shown in FIG. 1A.
Figure 1C:
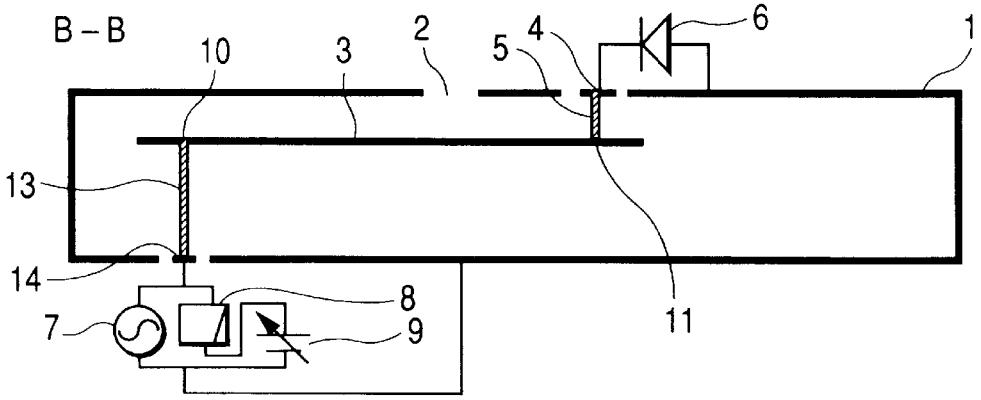
FIG. 1C is a cross-sectional view taken along line B—B of FIG. 1A, for describing the first embodiment of the tunable slot antenna shown in FIG. 1A.

FIGS. 1A, 1B and 1C respectively show a coaxial resonant slot antenna wherein a variable capacitor is placed on the upper surface of a flat conductive cubic and a conductive island for drawing a connection point from the flat conductive cubic to the outside is provided at the bottom face of the flat conductive cubic. FIG. 1A is a perspective view showing the coaxial resonant slot antenna, FIG. 1B is a cross-sectional view taken along line A—A of FIG. 1A, and FIG. 1C is a cross-sectional view taken along line B—B of FIG.

1A. In FIGS. 1A, 1B and 1C, there are shown a variable capacitor 6, a capacitor connecting point 11 provided on a strip conductor 3, a conductive island 4 formed on the upper surface of a flat conductive cubic 1 just above the capacitor connecting point 11 kept away from a portion of a slot 2, a through hole 5 for electrically connecting the capacitor connecting point 11 and the conductive island 4 to each other, a conductive island 14 provided at the bottom face of the flat conductive cubic 1 located just below a connection point 10, a through hole 13 for electrically connecting the connection point 10 and the conductive island 14 to each other, a low-pass filter 8 for blocking leakage of a high-frequency current, and a variable d.c. source 9. A variable capacitance diode for varying the capacitance according to an applied d.c. voltage is used as the variable capacitor 6. Incidentally, the flat conductive cubic 1 is filled thereinside with an insulator for fixing the strip conductor 3. However, the insulator will not be shown in the drawing.

The conductive islands 4 and 14 are both formed in their corresponding small holes made in a side wall of the flat conductive cubic 1 so as not to make contact with the same side wall. The variable capacitor 6 is electrically connected between the conductive island 4 and one point of the side wall of the flat conductive cubic 1 located in the neighborhood thereof. The through hole 5 corresponds to the above-mentioned line conductor. The destination to draw the connection point 10 corresponds to the conductive island 14 to which an output terminal of a RF source 7 and one of terminals of the low-pass filter 8 are electrically connected. Further, the variable d.c. source 9 is electrically connected to the other of the terminals of the low-pass filter 8. As the RF source 7, one having an output terminal to which a capacitor is electrically connected and from which high-frequency power is outputted through the capacitor, is used. Thus, the output terminal is in an open state under action of a direct current. The application of the d.c. voltage to the variable capacitor 6 is performed by supplying a d.c. voltage from the variable d.c. source 9 to the conductive island 14 through the low-pass filter 8.

The variable capacitor 6 serves so as to apply capacitance between the capacitor connecting point 11 near the end far from the connection point 10 of the strip conductor 3 and ground (corresponding to the side wall of the flat conductive cubic 1). Therefore, the density of electric lines of force at the capacitor connecting point 11 increases as compared with the case where the variable capacitor 6 is disconnected. And the density of a current induced on the strip conductor 3 located in the neighborhood of the capacitor connecting point 11 increases so as to compensate for the increase in the density of electric lines of force. As a result, the strip conductor 3 looks as if to have varied its length, thus resulting in a variation in resonance frequency, i.e., impedance matching center frequency.

Since the capacitance value of the variable capacitor 6 can be varied according to the value of the applied d.c. voltage, the resonance frequency can be eventually changed by varying the value of the voltage supplied from the variable d.c. source 9. Thus, the change in the value of the voltage of the variable d.c. source 9 according to a radio frequency set for each phone call allows matching of the radio frequency with the resonance frequency. As a result, a frequency band for the antenna can be limited to a band necessary for a phone call and the volume of the antenna can be reduced. Incidentally, the variable d.c. source 9 changes the voltage under the control of a voltage control circuit (not shown). The voltage control circuit generates a control signal for specifying a voltage value corresponding to the radio frequency and the variable d.c. source 9 generates a predetermined d.c. voltage in accordance with the control signal. The variable d.c. source 9 has a control terminal (not shown) for inputting the control signal therein.

The present structure can be set to a flat thin-plate planar structure in a manner similar to the coaxial resonant slot antenna indicative of the prior art and may take a form of an external projection-free built-in antenna by being placed on a high-frequency circuit board such as a radio terminal or the like.

[Second Embodiment]

Figure 2A:
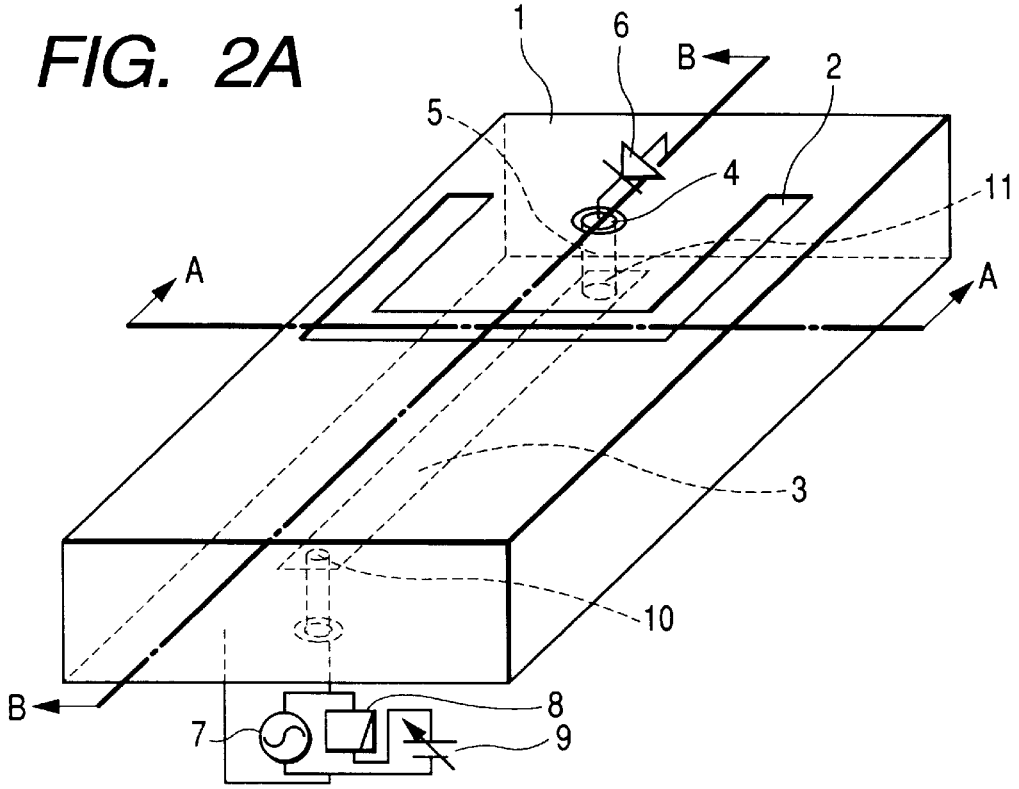
FIG. 2A is a perspective view for explaining a second embodiment of the present invention.
Figure 2B:
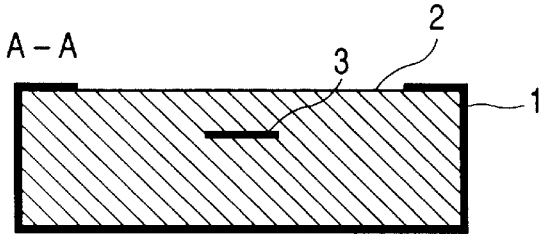
FIG. 2B is a cross-sectional view taken along line A—A of FIG. 2A, for describing the second embodiment shown in FIG. 2A.
Figure 2C:
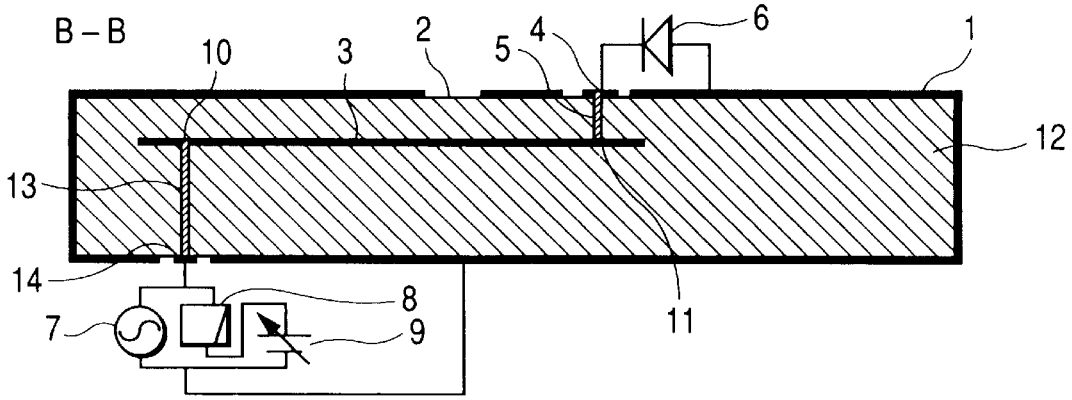
FIG. 2C is a cross-sectional view taken along line B—B of FIG. 2A, for describing the second embodiment shown in FIG. 2A.

An embodiment in which the flat conductive cubic employed in the first embodiment is filled thereinside with a dielectric material, is shown in FIGS. 2A, 2B and 2C. In the same drawings, reference numeral 12 indicates a dielectric material. Even when a variable capacitor 6 is connected, an electromagnetic field lying inside a flat conductive cubic 1 is reduced or cut down in inverse proportion to the square root of a dielectric constant of the dielectric material in a manner similar to the variable capacitor-free case (see the application referred to above). Therefore, the dimensions of the present antenna can be shortened as compared with the antenna (first embodiment) free of the dielectric material and having the same resonance frequency.

[Third Embodiment]

Figure 3A:
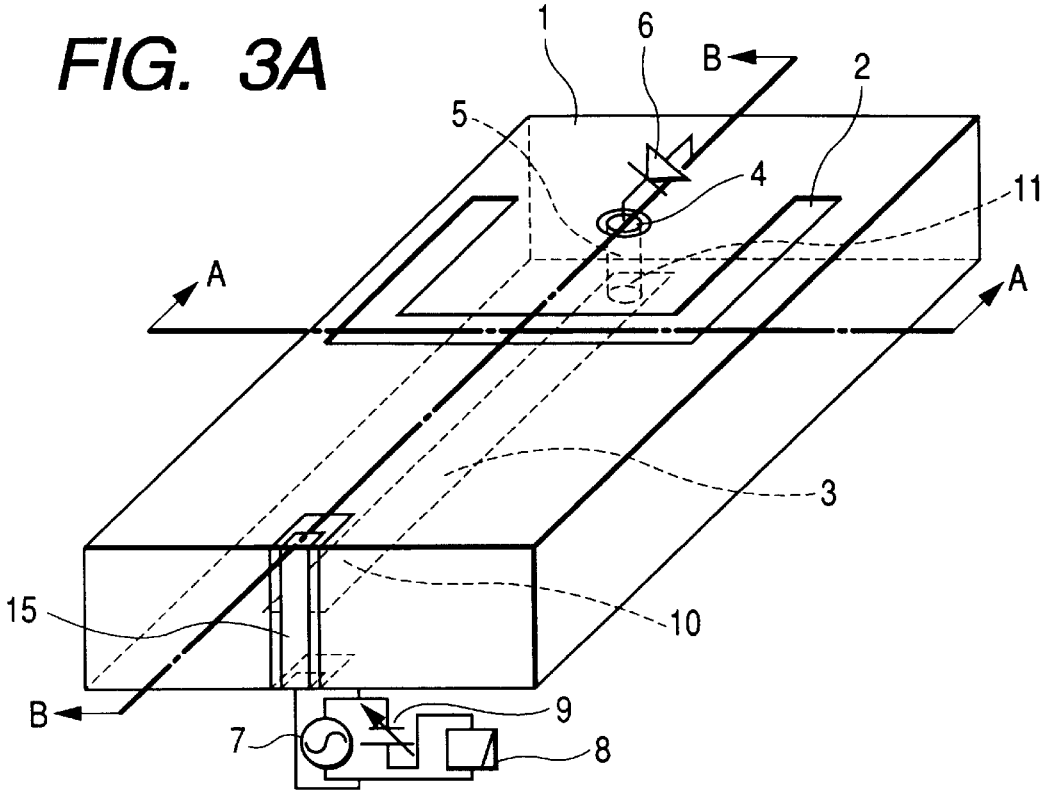
FIG. 3A is a perspective view for explaining a third embodiment of the present invention.
Figure 3B:
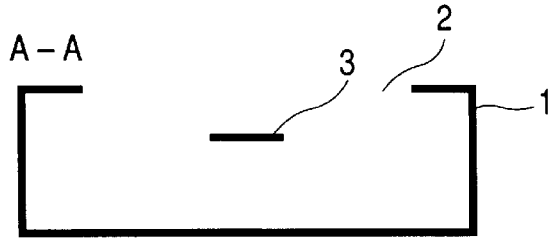
FIG. 3B is a cross-sectional view taken along line A—A of FIG. 3A, for describing the third embodiment shown in FIG. 3A.
Figure 3C:
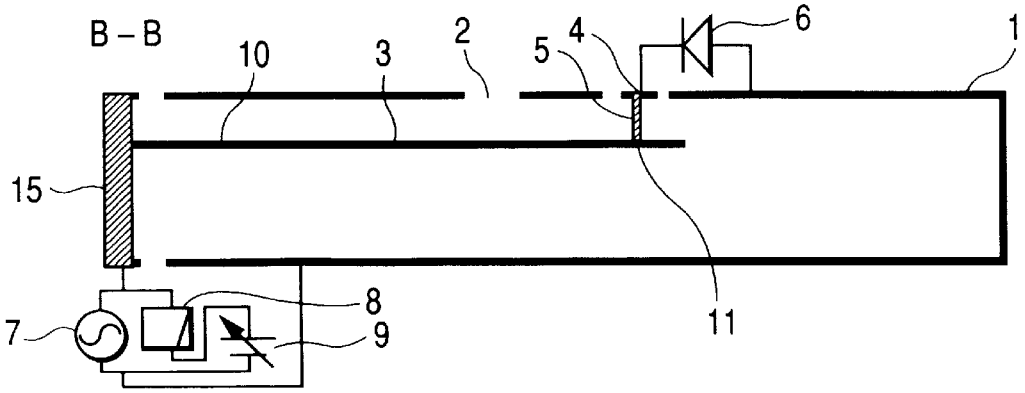
FIG. 3C is a cross-sectional view taken along line B—B of FIG. 3A, for describing the third embodiment shown in FIG. 3A.

An embodiment of an antenna wherein a connection point is drawn toward the outside from the side of a flat conductive cubic, is shown in FIGS. 3A, 3B and 3C. In the same drawings, reference numeral 15 indicates a side through hole formed in the side of a flat conductive cubic 1. The side through hole 15 is formed in a slender hole made in the side of the flat conductive cubic 1 so as not to make contact with a conductor surface corresponding to the side. A connection point 10 is electrically coupled to the side through hole 15 along the longitudinal direction of the flat conductive cubic 1. An output terminal of a RF source 7 and one of terminals of a low-pass filter 8 are electrically connected to the side through hole 15. Further, a variable d.c. source 9 is electrically connected to the other of the terminals of the low-pass filter 8.

According to the present embodiment, the side through hole 15 serves as the destination to draw the connection point 10 and the lower part of the side through hole 15 is flush with the bottom face (ground potential) of the flat conductive cubic 1. It is thus easy to implement the present antenna on a circuit board. Namely, if a circuit board with a wired conductor and a grounded conductor surface formed therein is prepared and the antenna is placed on the same circuit board with the bottom face down, then the wired conductor can be brought into contact with the side through hole 15 as it is simultaneously with contact between the bottom face and the grounded conductor surface. Thus, the ordinary automatic implementation can be achieved. As described above, the antenna according to the present embodiment has an advantageous effect in addition to the advantageous effect obtained in the first embodiment in that the manufacturing cost of a terminal to which the antenna is applied, can be reduced.

[Fourth Embodiment]

Figure 4A:
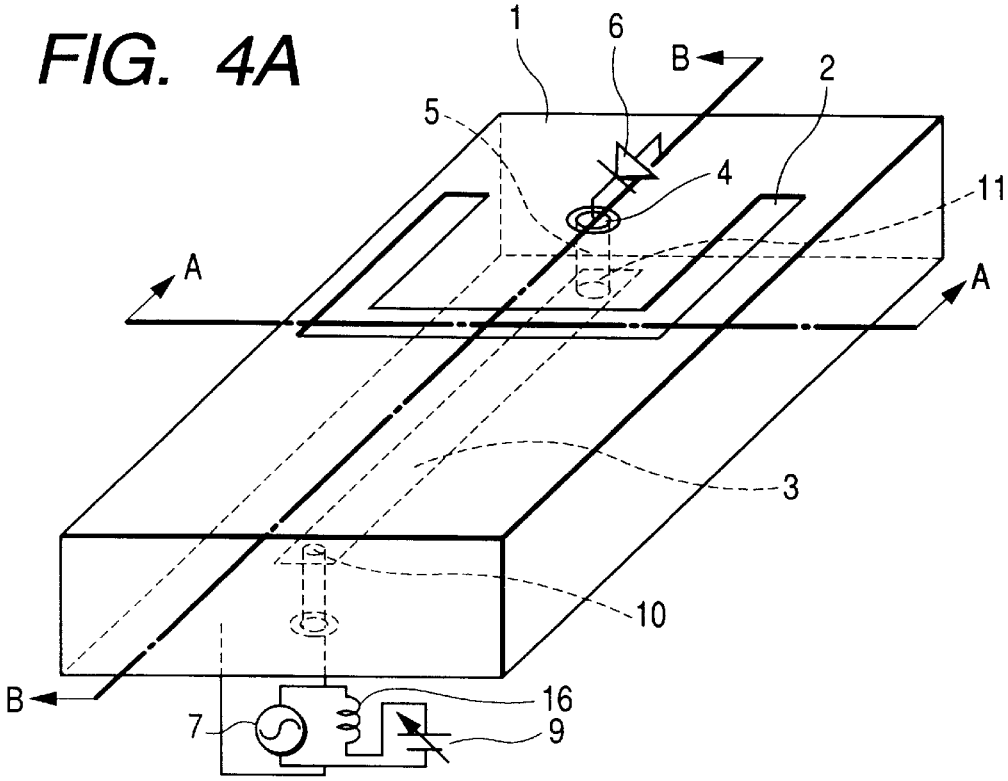
FIG. 4A is a perspective view for explaining a fourth embodiment of the present invention.
Figure 4B:
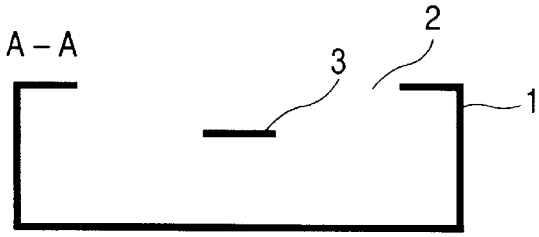
FIG. 4B is a cross-sectional view taken along line A—A of FIG. 4A, for describing the fourth embodiment shown in FIG. 4A.
Figure 4C:
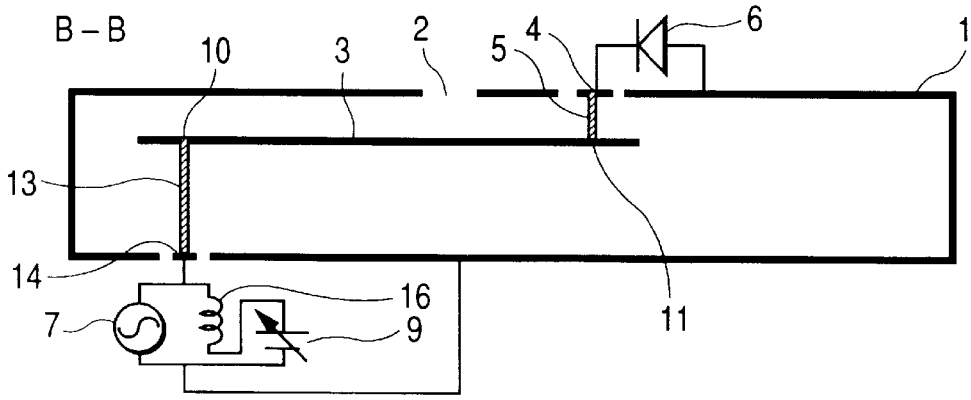
FIG. 4C is a cross-sectional view taken along line B—B of FIG. 4A, for describing the fourth embodiment shown in FIG. 4A.

An embodiment in which the low-pass filter employed in the first embodiment is replaced by an inductor, is illustrated in FIGS. 4A, 4B and 4C. In the same drawings, reference numeral 16 indicates an inductor. An ordinary RF source is designed predicated on 50-ohm matching. Therefore, when the inductance of the inductor 16 is selected as about 30 nH when the present antenna is used in a frequency band of a few GHz employed in the current radio communication system, then the impedance thereof results in 200 ohms or above and hence a high-frequency current that leaks into a variable d.c. source 9 through the inductor 16, results in a practically problem-free level. An inductance of about 30 nH at a few GHz band can be easily fabricated by a chip part, and an expensive low-pass filter can be replaced with an inexpensive inductor. The antenna according to the present embodiment has an advantageous effect in addition to the advantageous effect obtained in the first embodiment in that a terminal to which the antenna is applied, can be reduced in manufacturing cost.

Since a variable capacitance diode is used as the variable capacitor 6, a d.c. current flowing through the variable capacitor 6 becomes an extremely small current resultant from a leakage current from a bias circuit and hence the low-pass filter may be changed to a resistor. If the value of the resistor is set to 200 ohms or above in the same manner as described above, then the leakage or flow of the high-frequency current can be set to a practically problem-free extent.

[Fifth Embodiment]

Figure 5A:
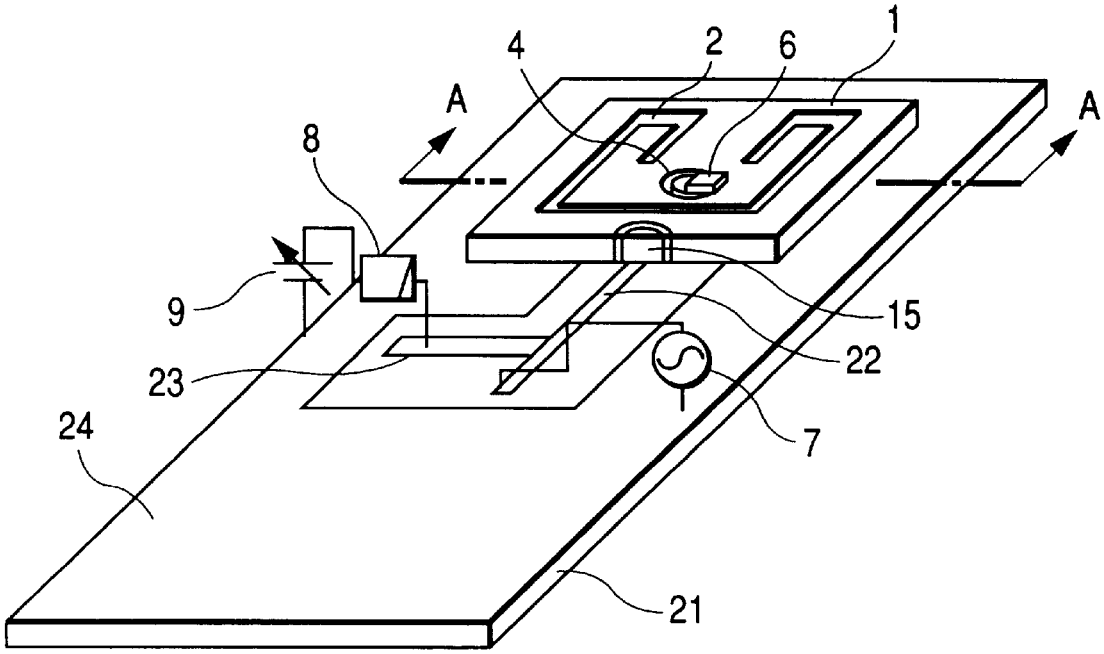
FIG. 5A is a perspective view for explaining a fifth embodiment of the present invention.
Figure 5B:
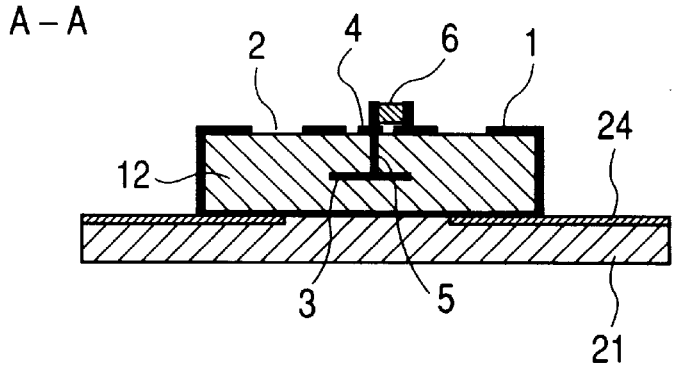
FIG. 5B is a cross-sectional view taken along line A—A of FIG. 5A, for describing the fifth embodiment shown in FIG. 5A.

An embodiment of an antenna mounted to a high-frequency circuit board and formed integrally with a low-pass filter, a variable d.c. source and a RF source is illustrated in FIGS. 5A and 5B. In the same drawings, reference numerals 21, 22, 23 and 24 indicate a high-frequency circuit board, a feeding wired conductor electrically connected to a side through hole 15, a stub of strip line extending from the wired conductor 22, and a grounded conductor surface of a substrate 21, respectively. A varactor diode chip is used as a variable capacitor 6. The varactor diode chip is implemented on a conductive island 4 and a small projected conductor formed on the upper surface of a flat conductive cubic 1 with the varactor diode chip interposed therebetween.

The antenna is provided in such a manner that the bottom face of the flat conductive cubic 1 is brought into contact with the conductive surface 24 and the side through hole 15 makes contact with one end of the wired conductor 22. A RF source 7 is implemented on the high-frequency circuit board 21 and has an output terminal electrically connected to the other end of the wired conductor 22 and a ground terminal electrically connected to one point of the conductive surface 24. A low-pass filter 8 and a variable d.c. source 9 electrically connected thereto are also packaged on the high-frequency circuit board 21. Further, one terminal of the low-pass filter 8 is electrically connected to one end of the stub of strip line 23 and a ground terminal of the variable d.c. source 9 is electrically connected to one point of the conductor surface 24.

Since the antenna according to the present embodiment can be brought to the ordinary automatic implementation in a similar to the third embodiment, it has an advantageous effect in that the manufacturing cost of a terminal to which the present antenna is applied, can be reduced.

[Sixth Embodiment]

Figure 6A:
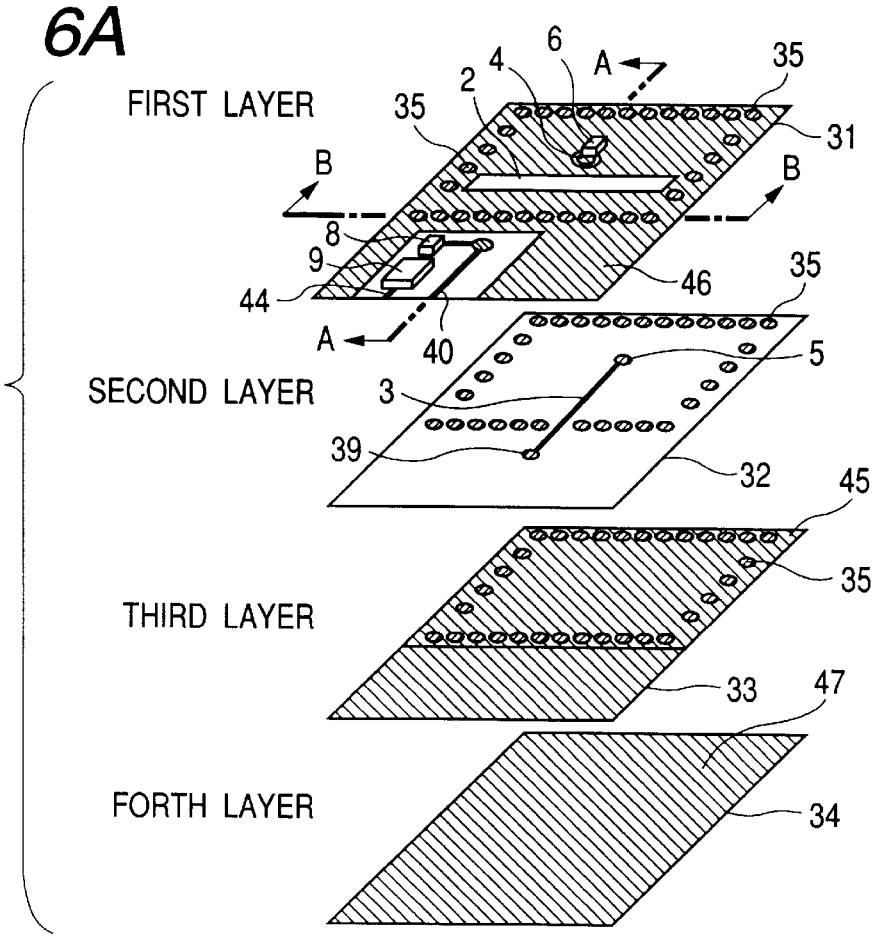
FIG. 6A is a perspective view for explaining a sixth embodiment of the present invention.
Figure 6B:
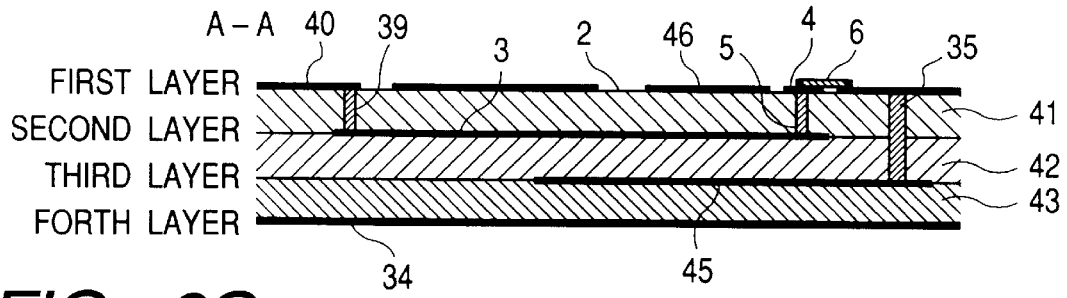
FIG. 6B is a cross-sectional view taken along line A—A of FIG. 6A, for describing the sixth embodiment shown in FIG. 6A.
Figure 6C:
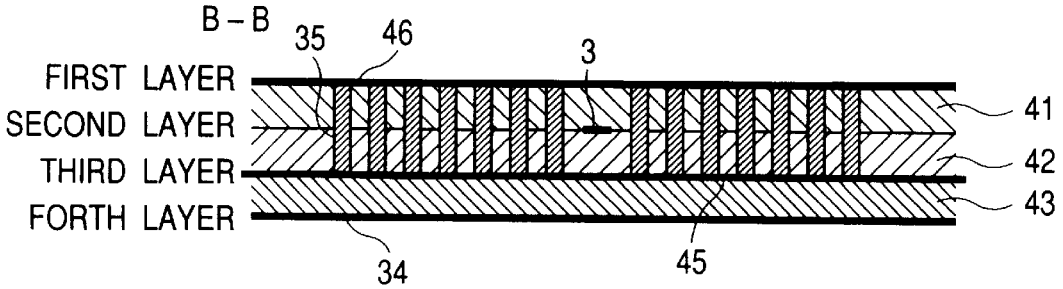
FIG. 6C is a cross-sectional view taken along line B—B of FIG. 6A, for describing the sixth embodiment shown in FIG. 6A.

An embodiment of an antenna constructed using a multilayer circuit board is shown in FIGS. 6A, 6B and 6C. The multilayer circuit board comprises three substrates or boards each comprised of a dielectric material. As seen from above, the surfaces of the first and second substrates are defined as first and second layers respectively and the surface and back of the third substrate are defined as third and fourth layers respectively. FIG. 6A is an exploded view showing the structure of the antenna, which is divided into respective layers. FIGS. 6B and 6C are respectively cross-sectional views of the antenna (not shown) completed with the three substrates bonded to each other, taken along lines A—A and B—B of FIG. 6A.

In FIGS. 6A, 6B and 6C, reference numerals 31, 32, 33 and 34 indicate the first, second, third and fourth layers in order respectively. Reference numerals 41, 42 and 43 indicate dielectric materials for the first, second and third substrates respectively. Reference numerals 40, 44 and 46 respectively indicate a wired conductor for feeding RF power, a control wired conductor for supplying a control signal to a variable d.c. source 9, and a conductor surface all of which are formed in the first layer 31. Reference numeral 45 indicates an internal-layer conductor surface formed in the third layer 33. Reference numeral 47 indicates a conductor surface formed in the fourth layer 34. Reference numeral 39 indicates a drawing through hole for electrically connecting a connection point of a strip conductor 3 and the wired conductor 40 to each other. Reference numerals 35 indicates a plurality of side through holes for electrically connecting the conductor surfaces 46 and 45 to each other.

A slot 2 is defined by partially cutting the conductor surface 46. The strip conductor 3 is formed by processing a conductor surface formed in the second layer into a predetermined shape. Further, a conductive island 4 is formed in a small hole maked in a portion of the conductor surface 46 and non-superimposed on the slot 2, so as not to make contact with the conductor surface 46. A variable capacitor (varactor diode chip) 6 is implemented between the conductive island 4 and one point on the conductor surface 46 located in the vicinity of the conductive island 4. The through hole 5 and a through hole 39 are both formed between the first and second layers. The side through holes 35 are formed between the first and third layers after the substrates 41 and 42 have been bonded to one another.

In the neighborhood of a point where the wired conductor 40 and the through hole 39 are connected to each other, a low-pass filter 8 shaped into chip form and the variable d.c. source 9 shaped into IC form are implemented in a portion spaced away from the slot 2. One terminal of the low-pass filter 8 is electrically connected to a wired conductor branching off from the connected point of the wired conductor 40, an output terminal of the variable d.c. source 9 is electrically connected to the other terminal of the low-pass filter 8, and the control wired conductor 44 is electrically connected to a control terminal of the variable d.c. source 9.

The plurality of side through holes 35 are squarely placed inclusive of the slot 2, the conductive island 4 and the variable capacitor 6 so that a flat conductive cubic 1 (not shown as a box in the figure) is formed by the plurality of side through holes 35 and the conductor surfaces 45 and 46. Each of spaces or intervals of the side through holes 35 is set to a value slightly less than 1/100 of the resonant wave length of the antenna (normally selected to 1/100 or less). However, since the strip conductor 3 is formed so as to slightly exceed an arrangement formed by the side through holes 35, the interval of each through hole 35 is opened up to the extent to which the side through holes 35 do not make contact with the strip conductor 3 at this portion. The conductor surface 46, the conductor surface 45 and the plurality of through holes 35 serve as the upper surface, bottom face and sides of the flat conductive cubic 1, respectively.

Owing to the above-described structure, the coaxial resonant slot antenna having the integrally-formed flat conductive cubic 1, low-pass filter 8, variable d.c. source 9 and diode 6 is formed in the multilayer circuit board. Since the antenna according to the present embodiment can be fabricated using the ordinary multilayer board manufacturing process, the number of parts and the number of manhours needed to manufacture the antenna can be reduced. Thus, a radio terminal to which the present antenna is applied, can be reduced in manufacturing cost.

[Seventh Embodiment]

Figure 7A:
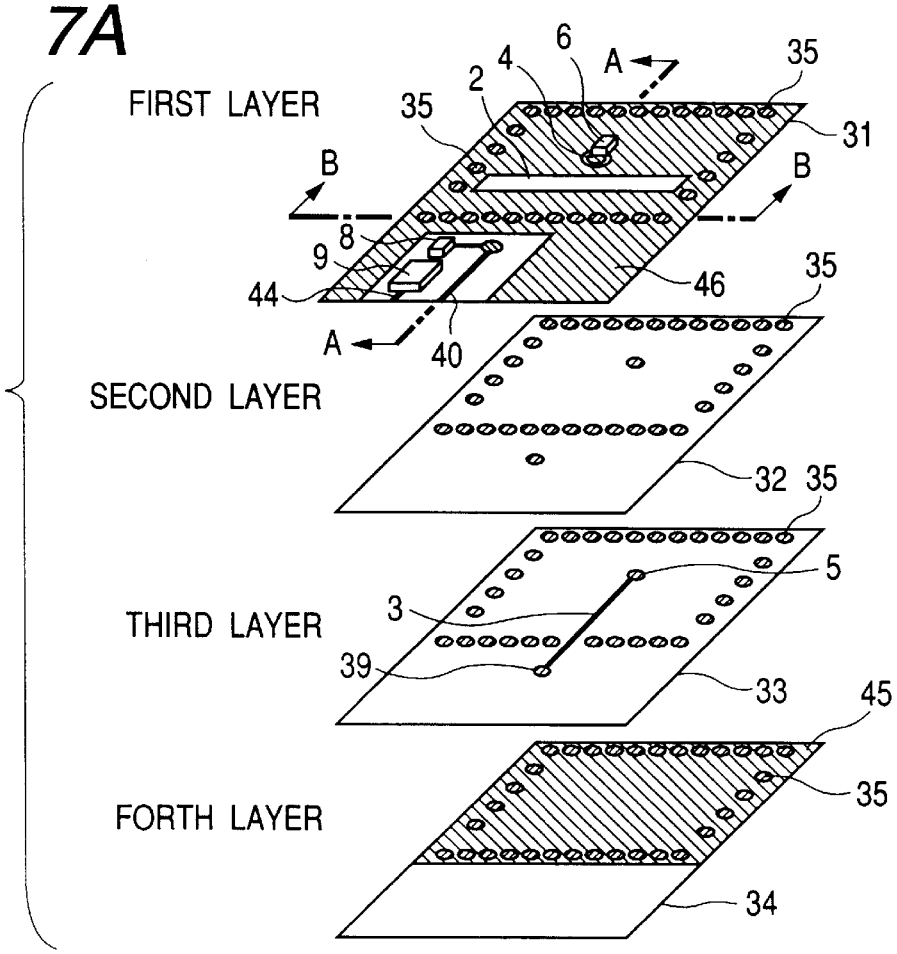
FIG. 7A is a perspective view for explaining a seventh embodiment of the present invention.
Figure 7B:
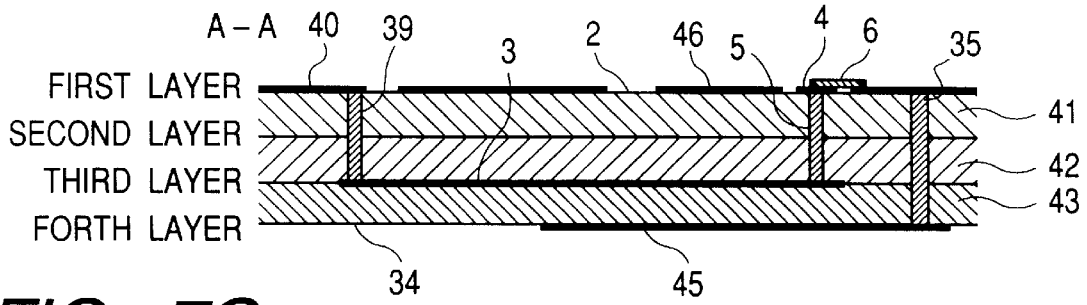
FIG. 7B is a cross-sectional view taken along line A—A of FIG. 7A, for describing the seventh embodiment shown in FIG. 7A.
Figure 7C:
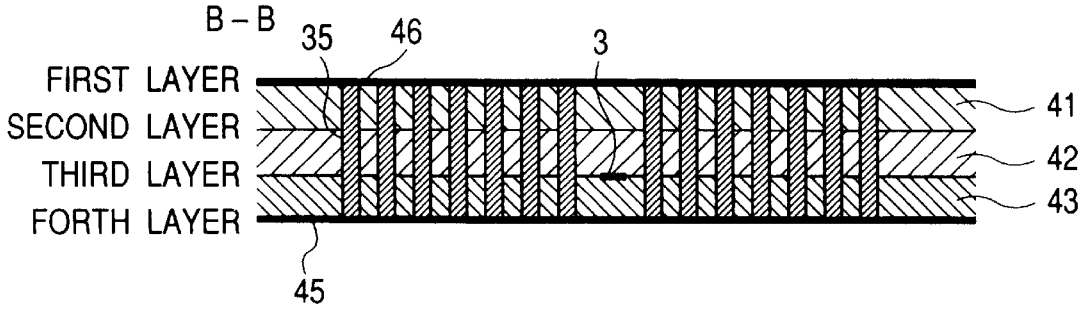
FIG. 7C is a cross-sectional view taken along line B—B of FIG. 7A, for describing the seventh embodiment shown in FIG. 7A.

An embodiment wherein the strip conductor 3 employed in the sixth embodiment is changed in placement and formed in a third layer, is illustrated in FIGS. 7A, 7B and 7C. A conductor surface is not formed in a second layer and a conductor surface 45 serving as the bottom face of a flat conductive cubic is formed in a fourth layer. Further, a plurality of side through holes 35 are defined so as to extend through dielectric materials 41, 42 and 43.

According to the present embodiment, since the volume of a cavity cubic formed by the plurality of side through holes 35, a conductor surface 46 formed in a first layer and the conductor surface 45 formed in the fourth layer becomes large as compared with the sixth embodiment, an impedance matching band of the antenna with its resonance frequency as the center can be increased. Thus, the antenna according to the present embodiment brings about an advantageous effect in that the degree of freedom to the design of an antenna structure of a radio terminal can be improved.

Incidentally, the second and third layers are turned upside down and the layer free of the strip conductor 3 can be configured as the third layer. In this case, an advantageous effect similar to the arrangement of the order of the second and third layer can be obtained.

[Eighth Embodiment]

Figure 8A:
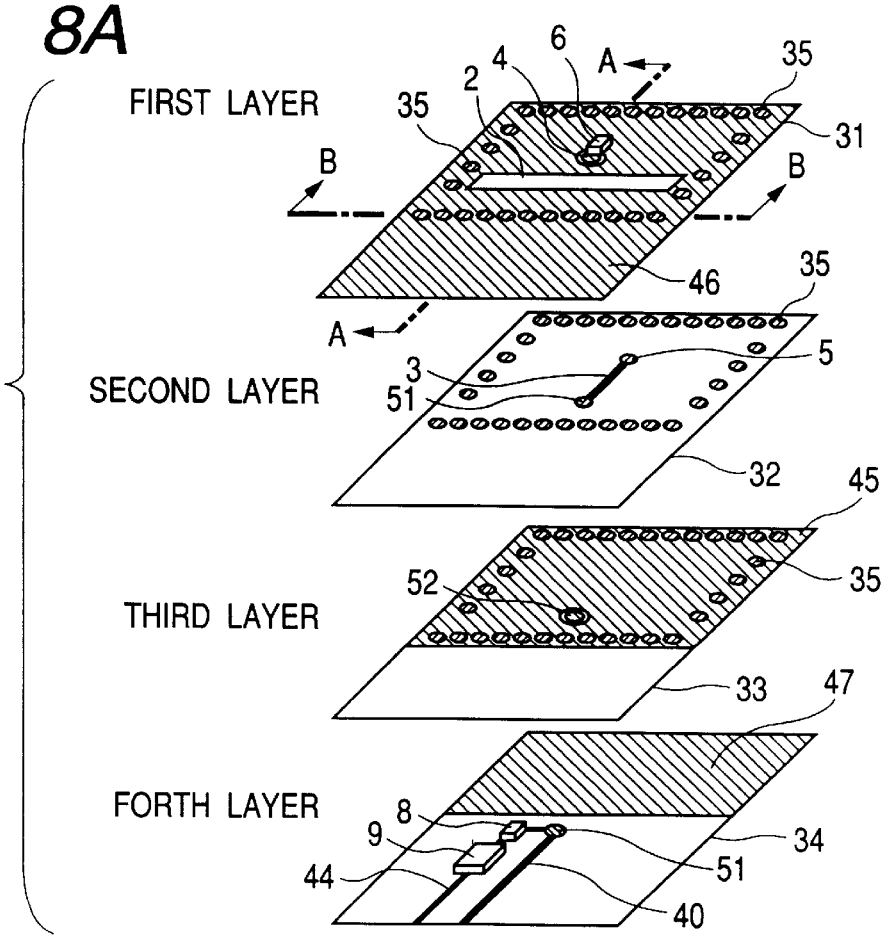
FIG. 8A is a perspective view for explaining an eighth embodiment of the present invention.
Figure 8B:
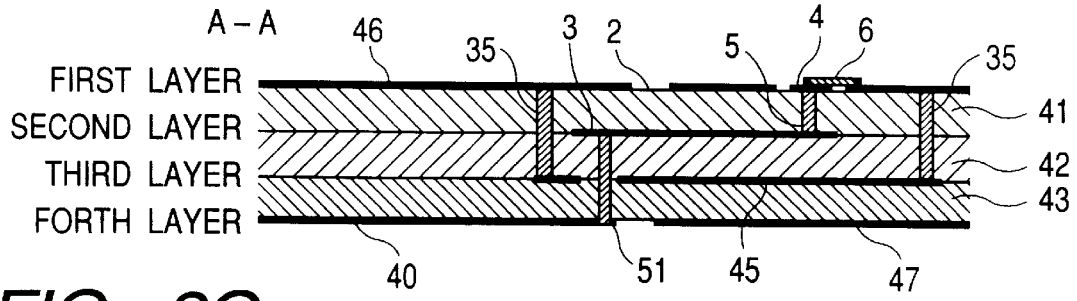
FIG. 8B is a cross-sectional view taken along line A—A of FIG. 8A, for describing the eighth embodiment shown in FIG. 8A.
Figure 8C:
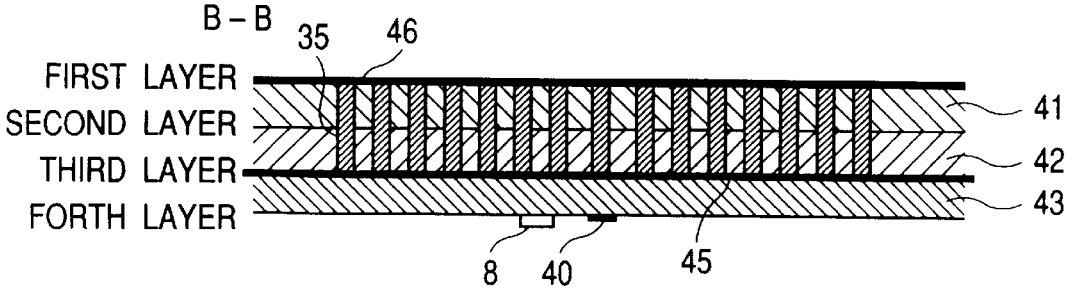
FIG. 8C is a cross-sectional view taken along line B—B of FIG. 8A, for describing the eighth embodiment shown in FIG. 8A.

An embodiment in which the wired conductors 40 and 44 employed in the sixth embodiment are placed in a fourth layer and a low-pass filter 8 and a variable d.c. source 9 are implemented in the fourth layer, is shown in FIGS. 8A, 8B and 8C. A strip conductor 3 is placed inside a square formed by a plurality of side through holes 35 and a drawing through hole 51 for connecting a connection point of the strip conductor 3 to the wired conductor 40 is formed between the second and fourth layers. A hole 52 for electrically isolating the through hole 51 from a conductor surface 45 and allowing it to pass therethrough is made in the conductor surface 45. A conductor surface 47 is formed on a reduced basis so as not to make contact with the wired conductors 40 and 44.

According to the present embodiment, since the interference with an antenna power feeding system comprising the wired conductor 40, the low-pass filter 8, etc. formed in the fourth layer by radiation power emitted through a slot 2 formed in the first layer can be restrained, the antenna according to the present embodiment brings about an advantageous effect in that the receiving sensitivity of a radio terminal to which the antenna is applied, can be enhanced.

[Ninth Embodiment]

Figure 9A:
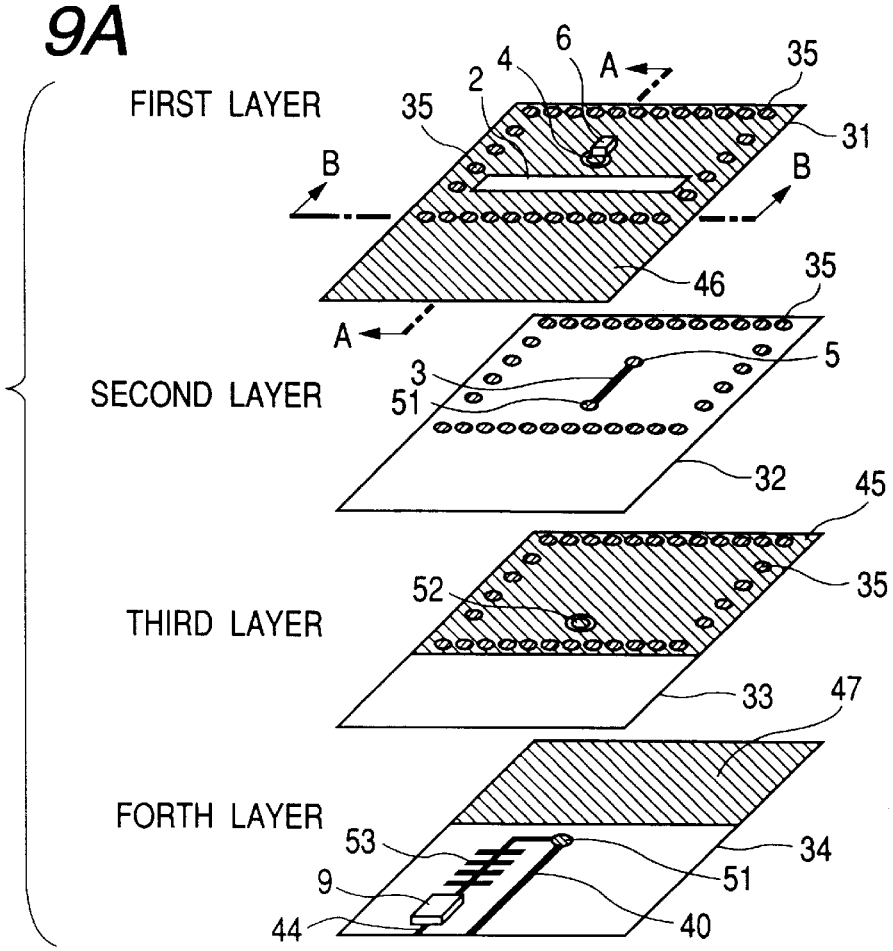
FIG. 9A is a perspective view for explaining a ninth embodiment of the present invention.
Figure 9B:
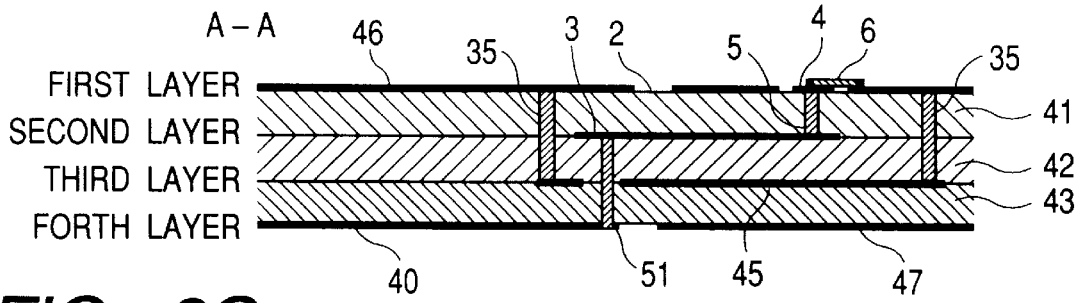
FIG. 9B is a cross-sectional view taken along line A—A of FIG. 9A, for describing the ninth embodiment shown in FIG. 9A.
Figure 9C:
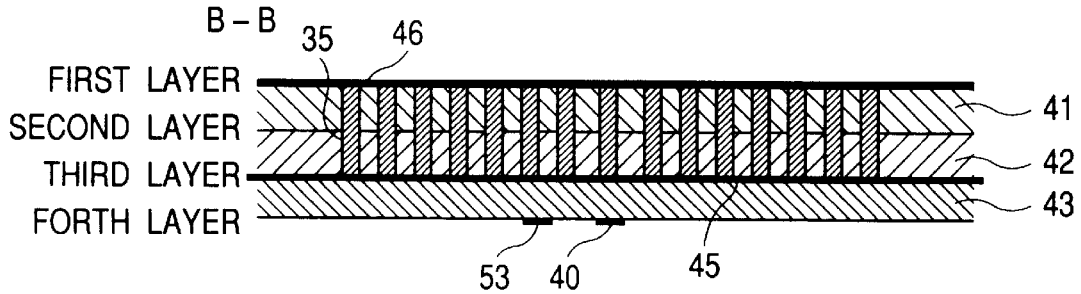
FIG. 9C is a cross-sectional view taken along line B—B of FIG. 9A, for describing the ninth embodiment shown in FIG. 9A.
Figure 10:
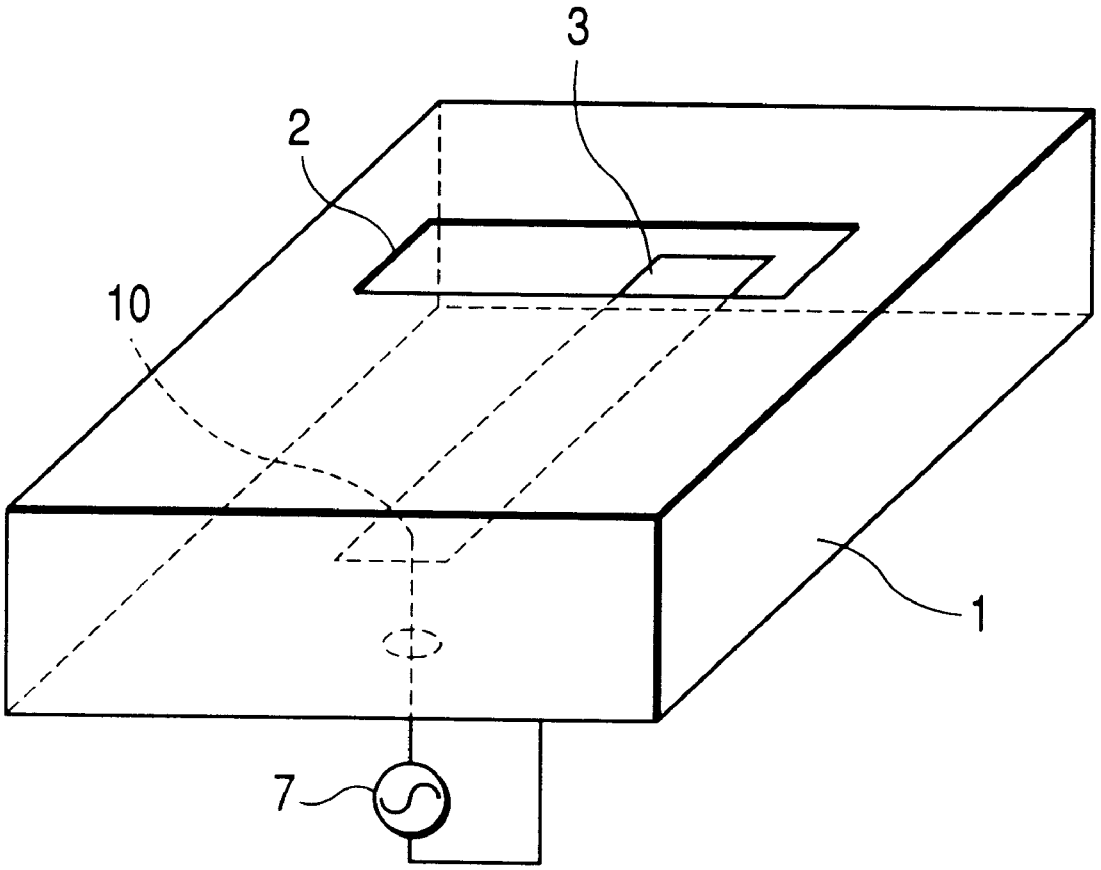
FIG. 10 PRIOR ART
FIG. 10 is a perspective view for describing a conventional slot antenna.

An embodiment in which the low-pass filter employed in the eighth embodiment is replaced by a high-frequency choke, is illustrated in FIGS. 9A, 9B and 9C. The high-frequency choke 53 can be implemented by a pattern formed by applying a comblike pattern to both sides of a wired conductor.

According to the present embodiment, since high-frequency parts can be reduced in number by replacing the filter with the wired conductor, the cost down to the antenna can be achieved by a reduction in the number of parts and the number of manhours needed to manufacture it. The antenna according to the present embodiment brings about an advantageous effect in that the manufacturing cost of a radio terminal to which the antenna is applied, can be reduced.

According to the present invention, an antenna can be achieved which is capable of varying an impedance matching center frequency (resonance frequency) by adding a variable capacitor to a strip conductor. If the present antenna is applied to a radio terminal, then the resonance frequency of the antenna is allowed to follow or respond to a radio frequency set for each phone call. Thus, a frequency band to be covered with the antenna can be reduced so that the volume of the antenna can be lessened. Owing to the application of the present antenna to the radio terminal, the radio terminal can eliminate for the need of a projection to thereby improve its portability and reduce its volume.

It is further understood by those skilled in the art that the foregoing description is a preferred embodiment of the disclosed device and that various changes and modifications may be made in the invention without departing from the spirit and scope thereof.

What is claimed is:

1. A tunable slot antenna comprising:

a flat conductive cubic shaped into a rectangular parallelepiped as a whole;

a slender strip conductor extending along the direction of a resonant axis of a space inside said flat conductive cubic, and placed so as to be isolated from said flat conductive cubic;

a radio wave transmitting and receiving slot formed in an upper surface of said flat conductive cubic so as to intersect said strip conductor at a position intermediate and spaced from ends of said strip conductor and forming a cross with said strip conductor;

means for supplying RF power between a connection point set to said strip conductor and a side wall of said flat conductive cubic; and a variable capacitor electrically connected between one point, said one point defining a capacitor connecting point, lying in the neighborhood thereof including an end far from the connection point of said strip conductor and the side wall of said flat conductive cubic.

2. A tunable slot antenna according to claim 1, wherein said variable capacitor has a capacitance value varied according to a d.c. voltage applied thereacross.

3. A tunable slot antenna according to claim 2, wherein a portion for supplying the d.c. voltage applied across said variable capacitor coincides with said connection point.

4. A tunable slot antenna according to claim 3, wherein a conductive island is formed in a small hole made in a conductor surface of the upper surface of said flat conductive cubic, said conductive island and said capacitor connecting point are electrically connected to each other by a line conductor, and said variable capacitor is electrically connected between said conductive island and one point of the side wall of said flat conductive cubic in the neighborhood of said conductive island.

5. A tunable slot antenna according to claim 4, wherein one terminal of a device for blocking a flow of a high-frequency current is electrically connected to said connection point and the other terminal of said device is a terminal for supplying the d.c. voltage applied across said variable capacitor.

6. A tunable slot antenna according to claim 5, wherein the device for blocking the flow of the high-frequency current is a low-pass filter.

7. A tunable slot antenna according to claim 5, wherein the device for blocking the flow of the high-frequency current is an inductor.

8. A tunable slot antenna according to claim 5, wherein said flat conductive cubic is filled thereinside with a dielectric material.

9. A tunable slot antenna according to claim 5, wherein a feeding line for supplying RF power and a d.c. voltage is electrically connected to said connection point and drawn through a small hole made in the bottom face of said flat conductive cubic.

10. A tunable slot antenna according to claim 9, wherein said feeding line comprises a conductive island formed in the small hole made in the bottom face of said flat conductive cubic, and a drawing through hole defined between said conductive island and said connection point.

11. A tunable slot antenna according to claim 5, wherein a feeding line for supplying RF power and a d.c. voltage is electrically connected to said connection point and drawn through a small hole made in a side of said flat conductive cubic.

12. A tunable slot antenna according to claim 11, wherein said feeding line comprises a side through hole defined in a side of said flat conductive cubic so as to be electrically isolated from the side thereof, said through hole being electrically connected to the connection point.

13. A tunable slot antenna according to claim 12, further comprising a high-frequency circuit board provided with a first wired conductor for supplying RF power and a d.c. voltage, a second wired conductor branching off from said first wired conductor, and a grounding conductor surface, and wherein said flat conductive cubic is implemented on said high-frequency circuit board so that the bottom face of said flat conductive cubic is electrically connected to said grounding conductor surface and the side through hole is electrically connected to an end of said first wired conductor, and an end of said second wired conductor is electrically connected to one terminal of the device for blocking the flow of the high-frequency current, whereas a voltage variable d.c. source for generating the d.c. voltage is electrically connected to the other terminal of said device.

14. A tunable slot antenna according to claim 13, wherein the device for blocking the flow of the high-frequency current is a high-frequency choke formed in said high-frequency circuit board by a pattern formed by adding a comblike pattern to both sides of a wired conductor.

15. A tunable slot antenna comprising:

a multilayer circuit board comprised of circuit boards stacked on each other so as to form first, second and third layers in order from above;

a flat conductive cubic having an upper surface comprised of a first conductor surface formed in the first layer and a slot formed by partially deleting said first conductor surface;

a strip conductor formed by a third conductor surface formed in the second layer;

said flat conductive cubic having a bottom face formed by a second conductor surface formed in the third layer and a side formed by a plurality of side through holes provided between the first and third layers so as to extend through the second layer;

a conductive island formed in said first conductor surface;

a variable capacitor implemented on said first conductor surface;

a line conductor for electrically connecting the conductive island and a capacitor connecting point, said line conductor having a through hole for capacitor connection formed between the first and second layers;

a voltage variable d.c. source for generating a d.c. voltage, said voltage variable d.c. source being electrically connected to the other terminal of a device for blocking a flow of a high-frequency current, whose one terminal is electrically connected to a connection point and being provided with a control terminal for receiving a control signal from a voltage control circuit for controlling a source voltage.

16. A tunable slot antenna according to claim 15, wherein another circuit board is interposed between the back of the circuit board having the first layer and the second layer, said plurality of side through holes extend through said another circuit board, and the front and back of said another circuit board are both covered with insulating materials over their entirety.

17. A tunable slot antenna according to claim 15, wherein another circuit board is interposed between the back of the circuit board having the second layer and the third layer, said plurality of through holes extend through said another circuit board, and the front and back of said another circuit board are both covered with insulating materials over their entirety.

18. A tunable slot antenna according to any of claims 15 through 17, wherein a feeding line for supplying RF power and a d.c. voltage is electrically connected to the connection point and drawn through a small hole made in the second conductor surface.

19. A tunable slot antenna according to claim 18, wherein said feeding line comprises a conductive island formed in a small hole made in the second conductor surface and a drawing through hole formed between the conductive island and the connection point.

20. A tunable slot antenna according to any of claims 15 through 17, wherein said strip conductor has one end near the connection point, which is drawn from the conductive cubic side formed by said plurality of side through holes to the outside so as to extend in non-contact with said through holes.

21. A tunable slot antenna according to claim 20, wherein a drawing through hole for supplying RF power and a d.c. voltage is defined between one end of said strip conductor and the first layer.

22. A tunable slot antenna according to claim 21, wherein a first wired conductor for the supply of RF power and a d.c. voltage and a second wired conductor branching off from the first wired conductor are formed in the first layer, said first wired conductor having an end to which the drawing through hole is coupled and connected, and said second wired conductor having an end to which one terminal of the device for blocking the flow of the high-frequency current is connected.

23. A tunable slot antenna according to claim 22, wherein the device for blocking the flow of the high-frequency current is a high-frequency choke formed in the first layer by a pattern formed by adding a comblike pattern to both sides of a wired conductor.

24. A tunable slot antenna according to claim 20, wherein the drawing through hole for supplying RF power and the d.c. voltage is formed between one end of said strip conductor and the third layer.

25. A tunable slot antenna according to claim 24, wherein a first wired conductor for supplying RF power and a d.c. voltage and a second wired conductor branching off from said first wired conductor are formed in the third layer, said first wired conductor having an end to which the drawing through hole is coupled and connected, and said second wired conductor having an end to which one terminal of the device for blocking the flow of the high-frequency current is connected.

26. A tunable slot antenna according to claim 25, wherein the device for blocking the flow of the high-frequency current is a high-frequency choke formed in the third layer by a pattern formed by adding a comblike pattern to both sides of a wired conductor.

* * * * *